United States Patent [19]

Obenchain

[11] 4,009,871

[45] Mar. 1, 1977

[54] METALLURGICAL FURNACE

[76] Inventor: Richard F. Obenchain, 3340 Comanche Road, Pittsburgh, Pa. 15241

[22] Filed: June 22, 1976

[21] Appl. No.: 698,356

[52] U.S. Cl. ..... 266/193; 266/197; 266/280

[51] Int. Cl.[2] ..... C21B 7/10; C21B 7/02

[58] Field of Search ..... 75/38–41, 75/43, 44 R, 44S; 266/190, 219, 192–194, 266/197–199, 280, 283, 900

[56] References Cited

UNITED STATES PATENTS 964,885 7/1910 Scott ..... 266/192

*Primary Examiner*—Gerald A. Dost

*Attorney, Agent, or Firm*—Parmelee, Miller, Welsh & Kratz

[57] ABSTRACT

In a metallurgical furnace having a shaft heating section for use with sized material, an improvement wherein a plurality of projections is formed on the interior wall of the preheat zone of the furnace. The length of the projections is equal to 5 to 15% of the diameter of the shaft and the projections are spaced from each other a distance equal to two to ten times the length thereof. The projections may be formed as concentric rings around the interior wall of the preheat zone of the furnace or as a continuous helix formed on the interior wall. If desired, cooling tubes may be placed within the projections.

6 Claims, 3 Drawing Figures

METALLURGICAL FURNACE

BACKGROUND OF THE INVENTION

1. Field of the Invention

This invention relates generally to metallurgical furnaces having a heating shaft for use with sized materials, and to the formation of the internal surface of the preheat zone of the furnace for the control of gas flow during operation of the furnace. More specifically, the present invention relates to improvements in metallurgical furnaces whose charge is relatively uniformly sized metallic oxides and carbonaceous fuel or relatively uniformly sized metal oxides and lump carbonaceous fuel. It is particularly suited to furnaces used in the reduction of iron oxide.

2. Prior Art

Over the last several decades, the reserves of high-grade metallic lump ores have been largely depleted. Therefore, numerous processes have been developed to upgrade finely divided high-grade ores, and to enrich such low quality ores as taconite. More recently, these processes have been applied to metallic wastes, such as blast furnace dust, BOF dust, open-hearth dust, mill scale, and other such materials produced in iron and steel making processes. They are also being applied to low quality coals and coke dust. These processes are generally known as "beneficiation."

Common to most of these processes is the agglomeration procedure. During agglomeration, the finely divided material is compacted into stronger, larger, more dense particles suitable for charging into a shaft furnace. The agglomerating step may include pelletizing, briquetting, extrusion and sintering. Whatever the agglomeration procedure, the product is ideally composed of small, uniformly sized particles whose largest dimension is generally less than 2 inches. These particles are made from finely divided metal oxides whose size may vary from one-quarter inch to submicron in size, or from long metallic strands or chips produced during finishing or machining operations.

After agglomeration, the agglomerates are delivered to a refining process for final use. The present invention relates to those processes which employ a metallurgical furnace having a shaft preheating section for using a sized charge of burden, or agglomerates. The term "vertical preheating section" as used herein is defined as a container for the sized burden, higher than it is wide, and utilizing an upward flow of gas or fluid through the sized burden to accomplish either heating or partial reduction of the oxide or metal with subsequent melting in the same or another vessel.

Prior to the development of beneficiation, shaft furnaces were charged with lump material. Gas flow through the lumps was irregular, having a tendency to seek out the path of least resistance. Where such a lump charge was used, the void spaces between lumps were generally large enough so that the gases would find or make a tortuous path through the material and preheat the same relatively uniformly. With the use of relatively small and uniform sized burden in shaft furnaces, however, the void spaces between agglomerates are relatively small, as compared to those with lump material, and the gas permeability of the charge is significantly reduced. Under these conditions, the gases have the tendency to channel or to find direct paths between the charge and the walls of the shaft furnace.

The present invention is designed to solve the problem of channeling at the periphery of shaft furnaces.

The formation of projections along the walls of furnaces has previously been proposed, such as is suggested in U.S. Pat. Nos. 3,379,427 and 3,843,106, but these projections and their purpose are not similar to those of the present invention. As suggested in U.S. Pat. No. 3,379,427, a blast furnace lining is proposed for the interior of the furnace, which lining, in the form of vertical metal plates, has projections and recesses to promote formation of a protective slag layer along water-cooled plates, but these plates to not form a continuous obstruction to gas flow. In U.S. Pat. No. 3,843,106, a furnace wall having coolers therein is proposed for use in an arc furnace, the purpose being to protect the walls from molten metal by formation of a protective layer of splash metal around the interior of the furnace bottom wall. Thus, these systems provide projections and recesses in the hot metal portions of the furnace to protect the furnace wall from molten slag and metal.

SUMMARY OF THE INVENTION

The present invention is an improvement in metallurgical furnaces for use with sized metal oxide burden having an average size of between ¼ to 2 inches in diameter. Where the metal oxide is in the form of agglomerates with flux or carbonaceous material present in the agglomerates, the agglomerates would be within the ¼ to 2 inch range. Where lump carbonaceous fuel or flux are separately added in addition to the metal oxide component, these additives may range up to about 4 inches in maximum diameter. Periodic projections are formed about the interior wall of the portion of the furnace wherein the sized material, while heated and possibly reduced, remains solid. The metallurgical furnace, in the preheating portion, has a diameter which may vary depending upon the size of the furnace. The projections on the preheating portion of the present furnace have a length of between 5 to 15% of the diameter of the preheat portion and are spaced apart a distance equal to about 2 to 10 times the length thereof. The projections may be formed as stacked parallel rings on the interior wall of the preheating portion or as a helix on the interior wall thereof. If desired, cooling means may be formed within the projections so as to provide for cooling of the interior wall of the furnace in the preheat section. In one embodiment, the diameter of the interior wall of the portion of the furnace wherein the sized material remains solid decreases as the distance from the bottom of the furnace increases.

DETAILED DESCRIPTION OF THE PREFERRED EMBODIMENT

Figure 3:
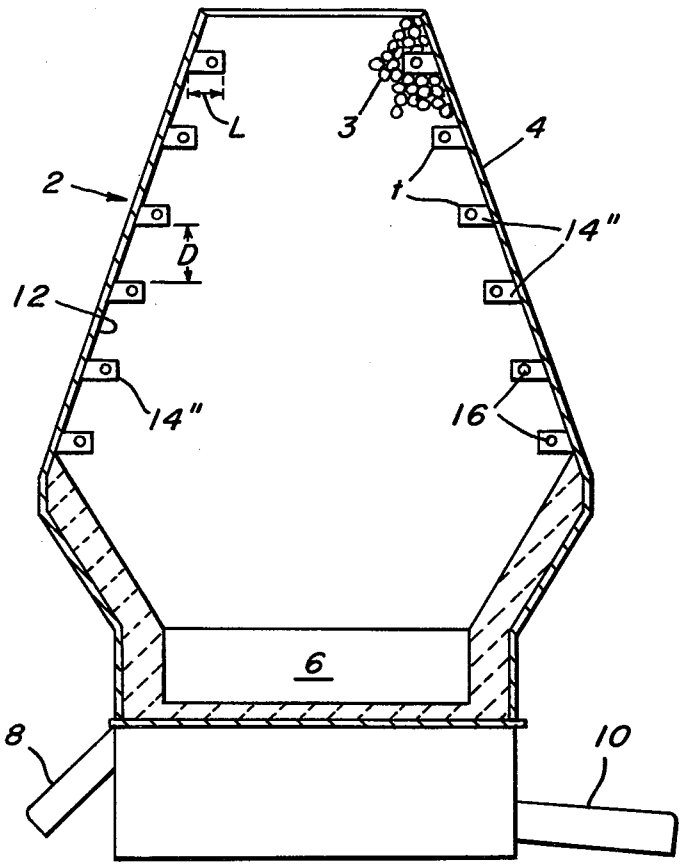
FIG. 3 is an elevation view partly in section of a metallurgical furnace showing another embodiment of the present invention.
Figure 1:
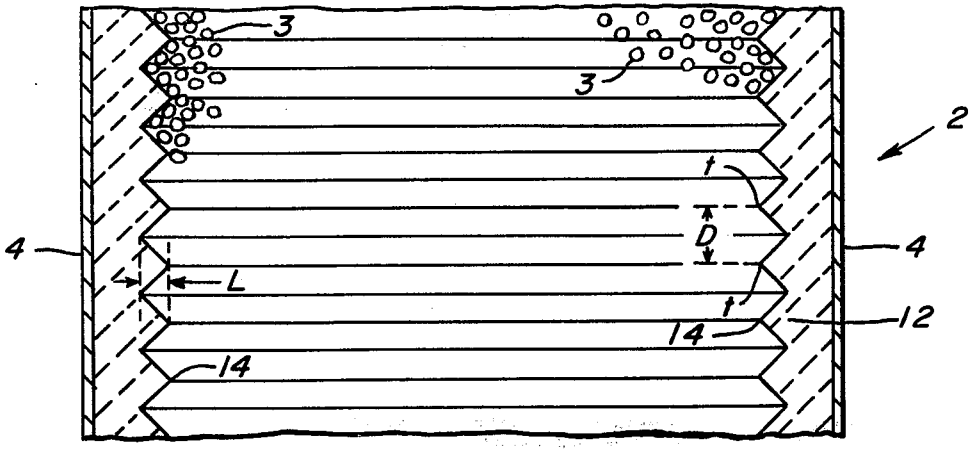
FIG. 1 is an elevation view in section of a portion of a metallurgical furnace showing one embodiment of the projections of the present invention.
Figure 2:
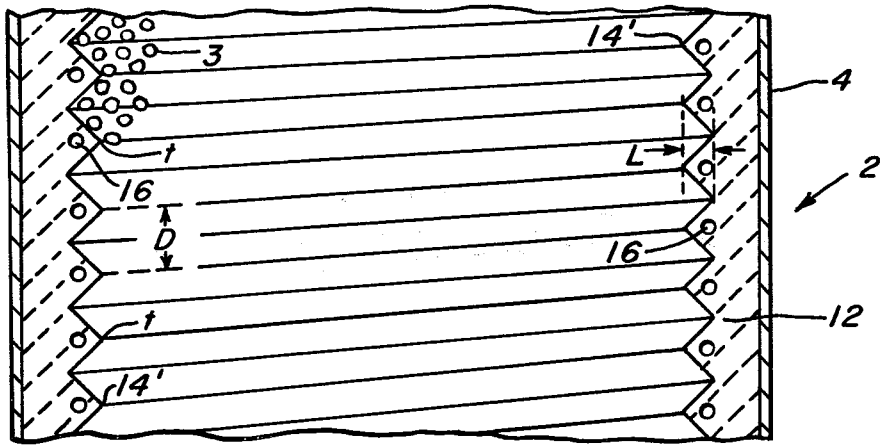
FIG. 2 is a view similar to FIG. 1 showing another embodiment of the projections of the present invention.

Referring to FIGS. 1 and 2, a preheating portion 4 of a metallurgical furnace is shown. The portion 2 is of the type used for the reduction of sized lump or agglomerated materials which are charged into the upper end of the furnace. The metallurgical furnace may be in the form of a blast furnace or a cupola-type furnace or as an upper heating section for use with a reverberatory, induction melting or other type of final melting zone for the sized material. A cupola-type furnace is used in the following description, although such use is for the purpose of brevity only and not meant to be limiting. In the described embodiment, the furnace is charged with coke as fuel and is subsequently charged with sized material, such as agglomerated iron oxide pellets 3. The portion of the furnace 2 shown in FIGS. 1 and 2 is the preheat section 4 wherein the agglomerated material remains solid as it descends therethrough. Below the preheat section 4 is a melting zone 6 wherein melting of the agglomerated material occurs. As shown in FIG. 3, the furnace is provided with a slag tap 8 from which slag can be removed, and metal tap 10 from which the molten metal product can be removed.

In operation of the illustrated furnace, coke in the lower portion of the furnace 2 is ignited, and the heat produced by the burning of this coke passes upward through the agglomerated material causing melting of the pellets 3 in the melting section 6 and heating of the pellets 3 in the preheat section 4. For proper operation of the furnace 2, it is necessary that the hot gases produced by the burning coke pass evenly through all portions of the charged material in the preheat section 4. However, the gases take the path of least resistance and tend to follow paths or channels through the material wherein there is less resistance to the flow of the gases. This effect, known as channeling, can cause uneven heating of the charged material in the preheat section 4 and lower the efficiency of the operation. With lump or bulk material, this channeling effect can happen anywhere in the charge wherein an opening or path occurs. However, with regularly formed agglomerated or sized materials, such as pellets, or other relatively uniformly sized material 3, channeling will normally occur along the interior walls 12 of the furnace 2.

To prevent the channeling of the gases along the interior walls 12, the walls 12 are formed with projections 14 which break up the flow of the gases along the interior walls 12. This provides a more tortuous route for travel of the gases, and increases the pressure requirements for gas flow along the periphery of the furnace 2, thus making more gas and pressure available for passage of the furnace gases through the central core of the charged material. As the hot gases are deflected inwardly, the impingement of these hot gases on the furnace shell is reduced making it easier to cool the shell, either by air or water.

In the embodiment shown in FIG. 1, the inward projections 14 are formed as stacked parallel rings. The projections 14 on the interior wall extend inwardly towards the center of the furnace and have a length L equal to between about 5 to 15% of the diameter of the preheating portion of the furnace. Adjacent projections 14 are spaced apart a distance D equal to between 2 to 10 times the length L of the projections, the distance D being measured from the most inward terminus *t* of the projections 14.

In another embodiment shown in FIG. 2, the projections are formed in the form of a helix on the interior wall 12 of the furnace 2, thus making, in effect, one continuous projection 14' extending from the top to the bottom of the preheat section 4 of the furnace 2. The length of the projections 14' are the same in this embodiment as in the embodiment discussed above. As shown in FIG. 2, cooling means, such as water-cooled tubes 16, may be constructed within the projections 14' so as to provide for a cooling medium in the preheat zone 4, if desired. These cooling tubes 16 can be incorporated into either of the embodiments shown in FIGS. 1 and 2. Cooling may not be required in some applications.

Referring now to FIG. 3, another embodiment of the furnace of the present invention is shown wherein the projections 14'' have horizontal upper and lower surfaces as opposed to the sloping upper and lower surfaces in the prior embodiments. In this embodiment, the horizontal length L of the projections 14'' is still equal to 5 to 15% of the diameter of the preheating portion but, where tapered walls are present, this percentage is based upon the more narrow diameter of the preheating portion. The adjacent projections, as in the previously described embodiments, are spaced apart a distance D, which is between 2 to 10 times the length L of the projections 14''. The distance D, where no single terminus point *t* is present, is measured from the closest terminal point, such as the lowermost point on the terminus of an upper projection and the uppermost point on the terminus of a lower projection. The embodiment may also include cooling means 16 formed within the projections 14''.

The interior walls 12 of the preheat section 4 of the furnace 2 may be vertical as shown in FIGS. 1 and 2, or the diameter may decrease as the distance from the bottom of the furnace increases as shown in FIG. 3. The length L and distance D must be within the specified ranges in order to retain sufficient sized material on the projections within the preheating section of the furnace to divert hot gases to the center of the furnace without interfering with the ready flow of the vast majority of the sized material downwardly and gases upwardly in the furnace. Too long a length L would prevent free flow of sized material downwardly and block the flow of gases while too short a length would not reduce the channeling. Also, too far a spacing of adjacent projections would permit channeling between projections, while too close a spacing would not retain sized material intermediate projections and would, in effect, only create a wall-type formation that would be subject to channeling therealong. With the prescribed dimensions, a tortuous path for the hot gases is achieved throughout the sized charge in the preheating section.

There has been disclosed an improvement in metallurgical furnaces wherein the resistance to the flow of gases at the periphery of the shaft in the preheat section is increased to a value comparable to the resistance at any other point in the shaft. The result of this increased resistance at the periphery is to cause a uniform flow of gas through all portions of the charge, resulting in greater uniformity and efficiency in the operation of the furnace. In addition to enhancing the preheating of charge in the preheating portion of the furnace, the detention of charge material by the projections provides a buffer zone for the furnace wall to reduce the intensity of the heat on the furnace wall and thus prolong the life thereof.

I claim:

1. In a metallurgical furnace for use with sized material wherein the metal oxide component of the material has an average size between ¼ to 2 inches in diameter, having a preheating portion of a specified diameter wherein the sized material remains as integral solids, the improvement comprising:

a plurality of inwardly directed projections about the interior wall of said preheating portion;

the projections having a length equal to between 5 percent to 15 percent of the diameter of the preheating portion, with adjacent projections being spaced from each other a distance equal to between two to ten times the length of the projections.

2. In a metallurgical furnace for use with sized material, the improvement defined in claim 1 wherein the projections form stacked parallel rings on the interior wall of the furnace.

3. In a metallurgical furnace for use with sized material, the improvement defined in claim 1 wherein the projections form a helix of the interior wall of the furnace.

4. In a metallurgical furnace for use with sized material, the improvement defined in claim 1 including cooling means formed within the projections.

5. In a metallurgical furnace for use with sized material, the improvement defined in claim 1 wherein the diameter of the interior wall of the portion of the furnace wherein the sized material remains solid decreases as the distance from the bottom of the furnace increases, and wherein the distance between adjacent projections is equal to between 2 to 10 times the diameter of the narrow portion of the furnace and the length of the projections are between 5 to 15 percent of the diameter of the narrow portion of the furnace.

6. In a vertical shaft for the heating of a sized burden for the production of molten metal from a metal oxide, wherein the burden is comprised of sized material, the metal oxide component of which has an average size between ¼ to 2 inches in diameter, and wherein the sized material remains as integral solids, the improvement comprising:

a plurality of inwardly directed projections about the interior wall of said vertical shaft;

the projections having a length equal to between 5 to 15 percent of the diameter of the vertical shaft, with adjacent projections spaced from each other a distance equal to between 2 to 10 times the length of the projections.

* * * * *